US006958744B2

(12) United States Patent
Nakamura

(10) Patent No.: US 6,958,744 B2
(45) Date of Patent: Oct. 25, 2005

(54) LIQUID CRYSTAL DISPLAY DEVICE

(75) Inventor: Norio Nakamura, Saitama-Ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 413 days.

(21) Appl. No.: 10/385,740

(22) Filed: Mar. 12, 2003

(65) Prior Publication Data

US 2003/0197673 A1 Oct. 23, 2003

(30) Foreign Application Priority Data

Mar. 12, 2002 (JP) ..... 2002-067498

(51) Int. Cl.[7] ..... G09G 3/36
(52) U.S. Cl. ..... 345/98; 345/90; 345/100
(58) Field of Search ..... 345/87–104, 204, 345/208–210

(56) References Cited

U.S. PATENT DOCUMENTS 5,686,932 A * 11/1997 Tomita ..... 345/94
5,945,972 A * 8/1999 Okumura et al. ..... 345/98
5,977,940 A * 11/1999 Akiyama et al. ..... 345/94
6,771,247 B2 * 8/2004 Sato et al. ..... 345/98
6,778,162 B2 * 8/2004 Kimura et al. ..... 345/90

* cited by examiner

*Primary Examiner*—Lun-yi Lao
(74) *Attorney, Agent, or Firm*—Oblon, Spivak, McClelland, Maier & Neustadt, P.C.

(57) ABSTRACT

A liquid crystal display device includes pixels having pixel electrodes and a common electrode. A liquid crystal material is held between the pixel electrodes and common electrode. Pixel switches are provided to supply video signals to the pixel electrodes. A plurality of memories are provided to store the video signals in a digital form supplied from the switches to the pixel electrodes. Connection controllers connect the memories to the pixel electrodes and periodically reverse polarities of the video signals output from the memories to the pixel electrodes with respect to potential of the common electrode. A potential setting terminal is provided and auxiliary capacitor lines connected to the potential setting terminal constitute capacitive coupling with the pixel electrodes. Separation circuits are provided to keep the auxiliary capacitor lines in an electrically floating state by electrically disconnecting the auxiliary capacitor lines from the potential setting terminal while the connection controllers connect the memories to the pixels.

14 Claims, 6 Drawing Sheets

LIQUID CRYSTAL DISPLAY DEVICE

FIELD OF THE INVENTION

This invention generally relates to a liquid crystal display device driven by video signals derived from regularly reversing the polarity of pixel signals and, more particularly, to a liquid crystal display device with memories for holding such video signals in digital form and supplying the video signals to pixel electrodes.

BACKGROUND OF THE INVENTION

Liquid crystal display (LED) devices have the advantages of being light weight, thin, and consuming low power, and as a result LCDs have been used for display devices for compact information processing terminals, such as mobile phones, electric dictionaries, etc. Since those compact information processing terminals are usually driven by batteries, it is quite important to reduce power consumption from a view point of making their operation time longer. In the case of a mobile phone, for instance, its power consumption must be as little as possible, at least in the standby state. As a method to comply with such a requirement, Japanese Patent Application Tokkaihei 58-23091 discloses an image display device with a digital memory provided for each pixel to hold a video signal. In this device, a significant reduction of power consumption can be made by suspending the operation of peripheral driving circuits except a control circuit to control the polarity of video signals supplied from the digital memory to pixel electrodes.

Meanwhile, mobile phones have been equipped with color halftone and moving picture display devices for internet, TV phone, etc. and further require high definition display devices with lower power consumption. In order to meet such requirements, a liquid crystal display device has been proposed to provide each pixel with a switch for selecting either one of two modes of operation: a normal display mode using ordinary thin film transistors and a still picture display mode using a digital memory. In this liquid crystal display device, where an area per pixel is made small to achieve high definition display, the digital memory provided for each pixel is necessarily so small in size that the digital memory restricts the driving capability of each pixel. In the case of such a restriction, it is quite difficult to secure a sufficient tolerance for dispersion of device characteristics depending on the device production process. Where the driving capability of a digital memory is lower than its designed values with respect to an electric capacitor of a liquid crystal and its auxiliary capacitor, a point defect takes place at a pixel mistakenly driven by that digital memory in the still picture display mode. This results in a lower yield rate of the liquid crystal display device.

SUMMARY OF THE INVENTION

The present invention provides a liquid crystal display device configured to reduce such point defects caused by the driving capability of a digital memory.

A liquid crystal display device of the present invention includes pixels, pixel switches to provide video signals, memories, connection control circuits, auxiliary capacitors, and separation circuits. Each pixel has pixel and common electrodes and a liquid crystal layer held between the pixel and common electrodes. The video signals are supplied to the pixel electrodes through the pixel switches. The memories store the video signals in a digital form. The control circuits connect the memories to the pixel electrodes and periodically reverse, with respect to a potential of the common electrode, the polarity of the video signals supplied from the memories to the pixel electrodes. The auxiliary capacitor lines are capacitor-coupled to the pixel electrodes and are also connected to potential setting terminals. The separation circuits make the auxiliary capacitor lines separate from the potential setting terminals and keep the potential setting terminals in an electrically floating state during a period of time when the connection control circuits connect the memories to the pixels.

In this liquid crystal display device, as set forth above, the separation circuits make the auxiliary capacitor lines separate from the potential setting terminals and keep the potential setting terminals in an electrically floating state during a period of time when the connection control circuits connect the memories to the pixels. As a result, since the auxiliary capacitor lines and auxiliary capacitors between the pixel electrodes are removed from capacitive loads to and from which the memories charge and discharge the video signal, respectively, the memories can correctly drive the pixels in response to the video signal even where the driving capability of the memories are lower than their designed values due to the dispersion of device characteristics based on the device production process. Thus, the liquid crystal display device can substantially avoid point defects on the display screen possibly caused by the insufficient driving capability of the memories.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
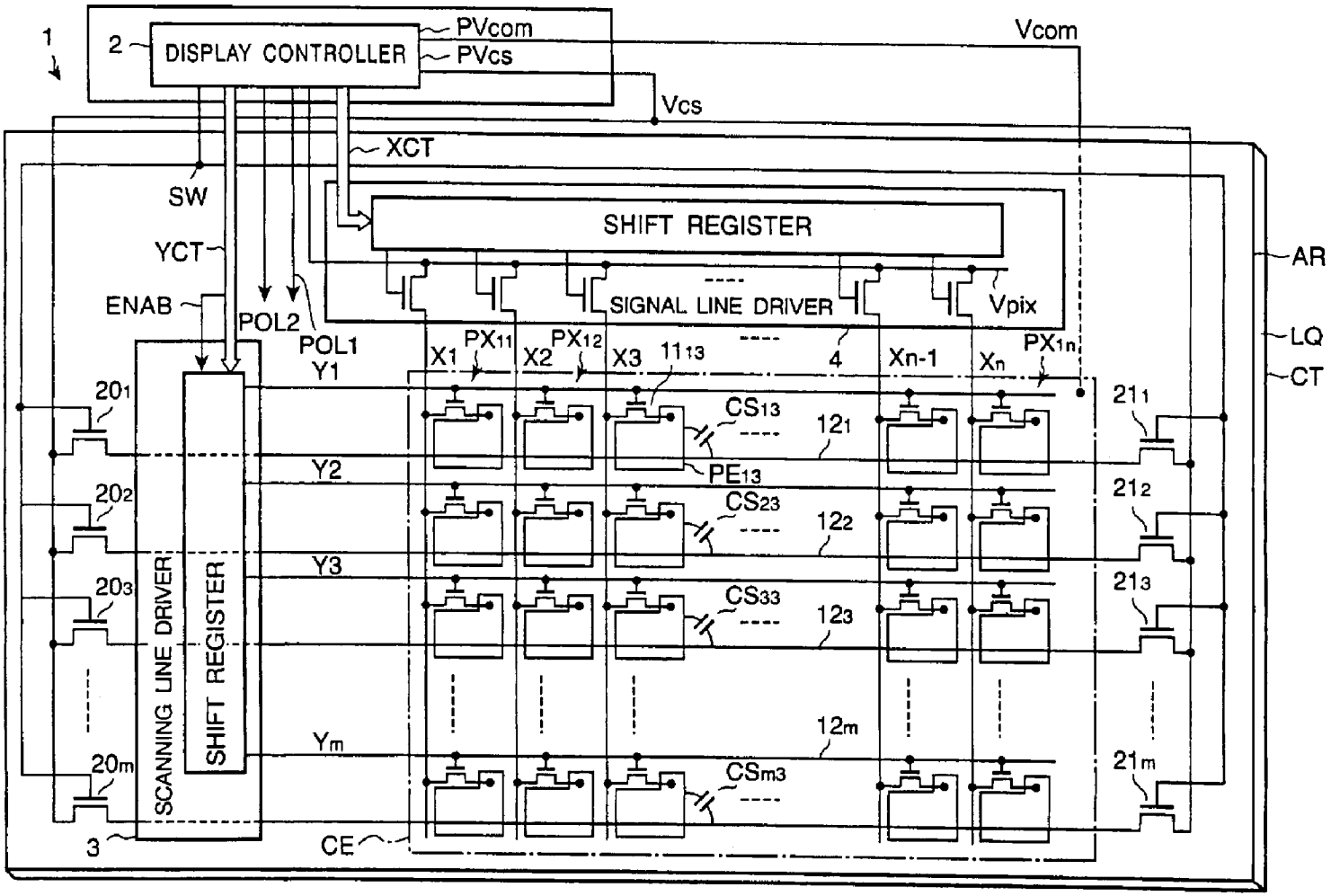
FIG. 1 is a schematic plan view to show the structure of an embodiment of a liquid crystal display device in accordance with the present invention.

Embodiments of an active matrix type liquid crystal display device in accordance with the present invention will be explained below with reference to the attached figures, in which like reference numerals indicate identical or corresponding elements throughout the figures. The active matrix display device is applicable to monitor displays of compact information processing terminals that are enabled to operate in an ordinary display mode of moving pictures and in a still picture display mode as well.

Figure 2:
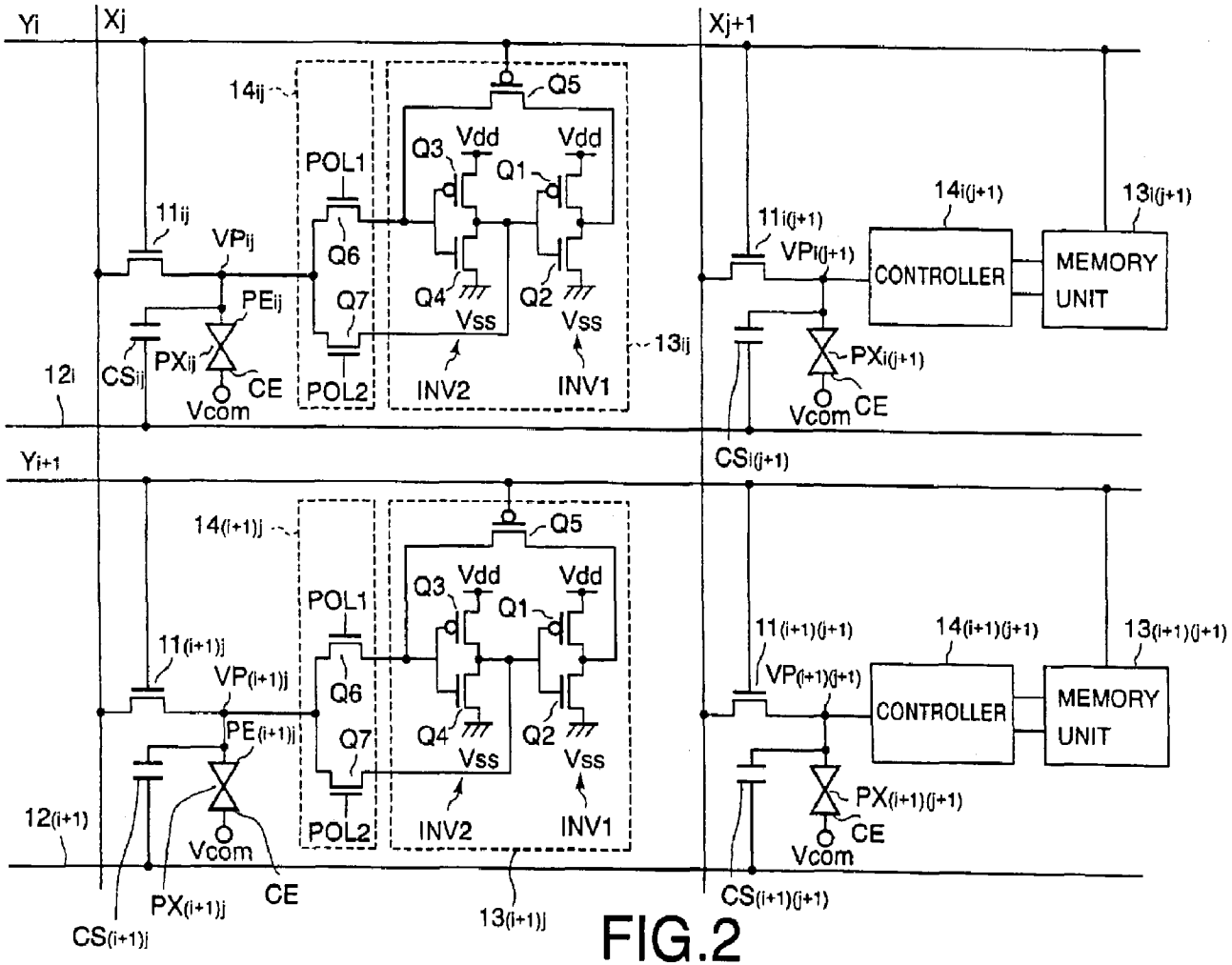
FIG. 2 shows equivalent circuits of pixels and their peripheral components of the liquid crystal display device shown in FIG. 1.

FIG. 1 shows a schematic plan view of the structure of such an active matrix type liquid crystal display device and FIG. 2 shows equivalent circuits of the pixels and their peripheral components in the liquid crystal display device shown in FIG. 1.

As shown in FIG. 1, the liquid crystal display device includes a display panel 1 and a display controller 2 to control the display panel 1. The display panel 1 is provided with a liquid crystal layer LQ, as an optical modulator, held between a circuit array substrate AR and a counter substrate CT. The display controller 2 is disposed on a driver substrate provided independently of the display panel 1.

The array substrate AR is equipped with pixel electrodes $PE_{11}$, $PE_{12}$, $PE_{13}$, . . . , and $PE_{mn}$, (collectively or individually called "PE"), scanning lines Y1, Y2, Y3, . . . , and Ym, (collectively or individually called "Y"), signal lines X1, X2, X3, . . . , and Xn, (collectively or individually called "X"), pixel switches $\mathbf{11}_{11}$, $\mathbf{11}_{12}$, $\mathbf{11}_{13}$, . . . , and $\mathbf{11}_{mn}$, (collectively or individually called "11"), auxiliary capacitor lines $\mathbf{12}_1$, $\mathbf{12}_2$, $\mathbf{12}_3$, . . . , and $\mathbf{12}_m$, (collectively or individually called "12"), separation circuits, or auxiliary capacitor switches, including thin film transistor switches $\mathbf{20}_1$, $\mathbf{20}_2$, $\mathbf{20}_3$, . . . , and $\mathbf{20}_m$, (collectively or individually called "20"), and $\mathbf{21}_1$, $\mathbf{21}_2$, $\mathbf{21}_3$, . . . , and $\mathbf{21}_m$, (collectively or individually called "21"), and scanning and signal line drivers 3 and 4.

The pixel electrodes $PE_{11}$, $PE_{12}$, $PE_{13}$, . . . , and $PE_{mn}$, (collectively or individually called "PE") are disposed in a matrix form on a glass substrate. The scanning and signal lines Y and X are provided along lines and rows of the pixel electrodes PE, respectively. The pixel switches 11 are provided adjacently to cross-points of the scanning and signal lines Y and X, respectively, and supply a video signal Vpix from the signal line X to the pixel electrodes PE, respectively, in response to scanning signals supplied to the scanning lines Y when the signal line drivers 4 turn on. The auxiliary capacitor lines 12 are provided approximately along the scanning lines Y, respectively, and are also provided across the lines of the pixel electrodes PE, respectively. The separation circuits 20 and 21 make the auxiliary capacitor lines 12 separated electrically from a potential setting terminal PVcs of the display controller 2. The separation circuits 20 and 21 each are connected between both end terminals of the auxiliary capacitor lines 12 and the potential setting terminal PVcs. The scanning and signal line drivers 3 and 4 drive the scanning and signal lines Y and X, respectively. The pixel switches 11 and separation circuits or auxiliary capacitor switches 20 and 21 are formed on the substrate AR as, for example, integrated circuits of N channel polycrystalline silicon thin film transistors (TFTs). The scanning and signal line drivers 3 and 4 and the thin film transistors 11 are also integrated on the array substrate AR as polycrystalline silicon P-channel and N-channel thin film transistors by applying same manufacturing processes to them.

The counter substrate CT includes a single common electrode CE indicated in a dotted and solid line, a color filter, etc. The common electrode CE is provided opposite to the pixel electrodes PE and is connected to a potential setting terminal PVcom of the display controller 2 as indicated in a dotted line in FIG. 1.

The display controller 2 receives video and synchronizing signals supplied from an external source, for instance, and generates a pixel signal Vpix in the ordinary mode and horizontal and vertical scanning control signals XCT and YCT, respectively. The vertical scanning control signal YCT includes a start pulse, a vertical clock pulse, an output enable signal ENAB, etc., and is supplied to the scanning line driver 3. Likewise, the horizontal scanning control signal XCT includes a start pulse, a horizontal clock pulse, a polarity reversing signal, etc. and is supplied to the signal line driver 4 together with the video signal Vpix.

The scanning line driver 3 includes a shift register, a buffer circuit, etc. and provides a scanning signal sequentially to the scanning lines Y to enable the pixel switches 11 to operate, respectively, every vertical scanning (frame) period in response to the vertical scanning control signal YCT. Every vertical scanning period, the shift register shifts the vertical start pulse supplied in synchronization with the vertical clock so that one of the scanning lines Y is selected and the shift register outputs the scanning signal to the selected scanning line with reference to the enable signal ENAB. The enable signal ENAB is kept at a high level to let the scanning line driver 3 output the scanning signal during an effective scanning period of the vertical scanning period but is kept at a low level to prohibit the scanning line driver 3 from outputting the scanning signal during a vertical blanking period excluding the effective scanning period from the vertical scanning period.

The signal line driver 4 includes a shift register, analog switches, etc. and carries out series-parallel conversion and sampling processes of a video signal Vpix supplied from the display controller 2 during one horizontal period (I H) in which each horizontal scanning line Y is driven by the horizontal scanning signal. As a result, the driver 4 outputs analog video signals and supplies those signals to the signal lines X in response to the horizontal scanning control signal XCT.

As shown in FIG. 1, the display controller 2 outputs a common potential Vcom from the potential setting terminal PVcom and an auxiliary capacitor potential Vcs from another potential setting terminal PVcs. The common and auxiliary capacitor potentials Vcom and Vcs are set at the common electrode CE and auxiliary capacitor lines 12, respectively, and may be equal in value to each other, for instance. The common potential Vcom reverses its levels from 0V to 5V or vice versa every horizontal scanning period (H) in the ordinary display mode and reverses its level from 0V to 5V or vice versa every frame period (F) in the still picture mode. In the ordinary display mode, however, the reversing of common potential level Vcom from 0V to 5V or vice versa may be carried out every two scanning periods (2H) or every one frame period (F) instead of reversing the same every one horizontal scanning period (1H).

The polarity reversing signal is supplied to the signal line driver 4 in synchronization with the reversing of common potential level Vcom. Thus, the signal line driver 4 outputs the video signal Vpix with the amplitude of 0V to 5V, the polarity of which is reversed with respect to the common potential Vcom, in response to the polarity signal in the ordinary display mode, and also outputs the video signal Vpix with halftone limitations to still pictures and then ceases its operation in the still picture display mode.

The liquid crystal display device 1 is configured to drive the liquid crystal layer in a normally white mode so that a black display is carried out by applying the video signal Vpix of 5V, for example, to the pixel electrode PE with respect to the common potential Vcom of 0V set at the common electrode CE. As set forth above, the liquid crystal display device is driven by the common-inversion drive scheme in the ordinary display mode but is driven by the frame-reversal drive scheme in the still picture display mode. In the common-inversion drive scheme, the video signal Vpix and the common potential Vcom are reversed alternatively every horizontal scanning period (H) while, in the frame-reversal drive scheme, they are reversed alternatively every frame period (F). The display screen is composed of pixels $PX_{11}$, $PX_{12}$, $PX_{13}$, . . . , $PX_{mn}$, (collectively or individually called "PX"). The pixel PX includes the pixel electrode PE, the common electrode CE, and the liquid crystal layer LQ held by the electrodes PE and CE.

Further, as shown in FIG. 2, digital memory units $\mathbf{13}_{11}$, $\mathbf{13}_{12}$, $\mathbf{13}_{13}$, . . . , and $\mathbf{13}_{mn}$, (collectively or individually called "13"), and connection control circuits or connection controllers $\mathbf{14}_{11}$, $\mathbf{14}_{12}$, $\mathbf{14}_{13}$, . . . , and $\mathbf{14}_{mn}$, (collectively or individually called "14"), are provided for the pixels PX. The pixel electrodes PE and the common electrode CE define electric capacitors holding the liquid crystal layer LQ as a dielectric material. The capacitors are connected to the pixel switches 11 and auxiliary capacitors $CS_{11}$, $CS_{12}$, $CS_{13}$, . . . , and $CS_{mn}$, (collectively or individually called "CS"). The pixel switch 11 selectively receives the video signal Vpix on the signal lines X. The auxiliary capacitor CS has an MIM (metal-insulation-metal) structure to include a first electrode made of a part of the auxiliary capacitor line 12, a second electrode connected to the pixel electrode PE opposite to the first electrode, and an insulation layer held between the first and second electrodes.

The auxiliary capacitor switches 20 and 21 are controlled by a switch control signal SW supplied from the display controller 2. In the ordinary display mode, the control signal SW is applied to the auxiliary capacitor switches 20 and 21 and makes the switches 20 and 21 conductive so that the auxiliary capacitor lines 12 are electrically connected to the potential setting terminal PVcs. In the still picture display mode, however, the auxiliary capacitor switches 20 and 21 are not conductive so that the auxiliary capacitor lines 12 are electrically separated from the potential setting terminal PVcs and are in electrically floating states.

The pixel switches PE are driven in response to the scanning signals applied to the scanning lines Y to transfer the video signal Vpix applied to the signal lines X to the pixel electrodes PE. The auxiliary capacitors CS are larger in capacity than the liquid crystal capacitors and charge or discharge the video signal Vpix applied to the pixel electrodes PE. In the case that the auxiliary capacitors CS hold the video signal by charging or discharging the same, the video signal thus held compensates the potential held by the liquid crystal capacitors when the pixel switches 11 are not conductive. This properly maintains the potential deference between the pixel and common electrodes PE and CE.

As shown in FIG. 2, each digital memory unit 13 includes P-channel polycrystalline silicon thin film transistors Q1, Q3, and Q5, and N-channel polycrystalline silicon thin film transistors Q2 and Q4, and holds the video signal from the pixel switch 11 to the pixel electrode PE and controller 14. Each controller 14 includes N-channel polycrystalline silicon thin film transistors Q6 and Q7, and controls both an electrical connection between the pixel electrode PE and the digital memory unit 13 and an output polarity of a video signal held at the digital memory unit 13. The thin film transistors Q1 and Q2 and the thin film transistors Q3 and Q4 are first and second complementary inverters INV1 and INV2, respectively, operated by power source voltages between power source terminal voltages Vdd (=5V) and Vss (=OV). The input terminal of the first complimentary inverter INV1 is connected to the output terminal of the second complementary inverter INV2 to configure a tandem inverter circuit. The output terminal of the first complimentary inverter INV1 is connected to the input terminal of the second complementary inverter INV2 through the thin film transistor Q5.

The thin film transistor Q5 functions as a feed-back loop switch to supply the output signal of the tandem inverter circuit to the input thereof. This thin film transistor Q5 is not conductive during the frame period in which the pixel switch 11 is conductive in response to a rise of the scanning signal from the scanning lines Y but is conductive during its next frame period. Thus, the thin film transistor Q5 is not kept conductive until at least the pixel switch 11 has read in the video signal Vpix.

The thin film transistors Q6 and Q7 are controlled by polarity control signals POL1 and POL2 alternatively set to be at a high level every frame period, for example, in the still picture display mode. The thin film transistor Q6 is connected to the pixel electrode PE, the input terminal of the complimentary inverter INV2, and the output terminal of the complimentary inverter INV1 through the thin film transistor Q5. The thin film transistor Q7 is connected between the pixel electrode PE and the input terminal of the complimentary inverter INV2 which, in turn, is connected to the output terminal of the complimentary inverter INV1.

Figure 3:
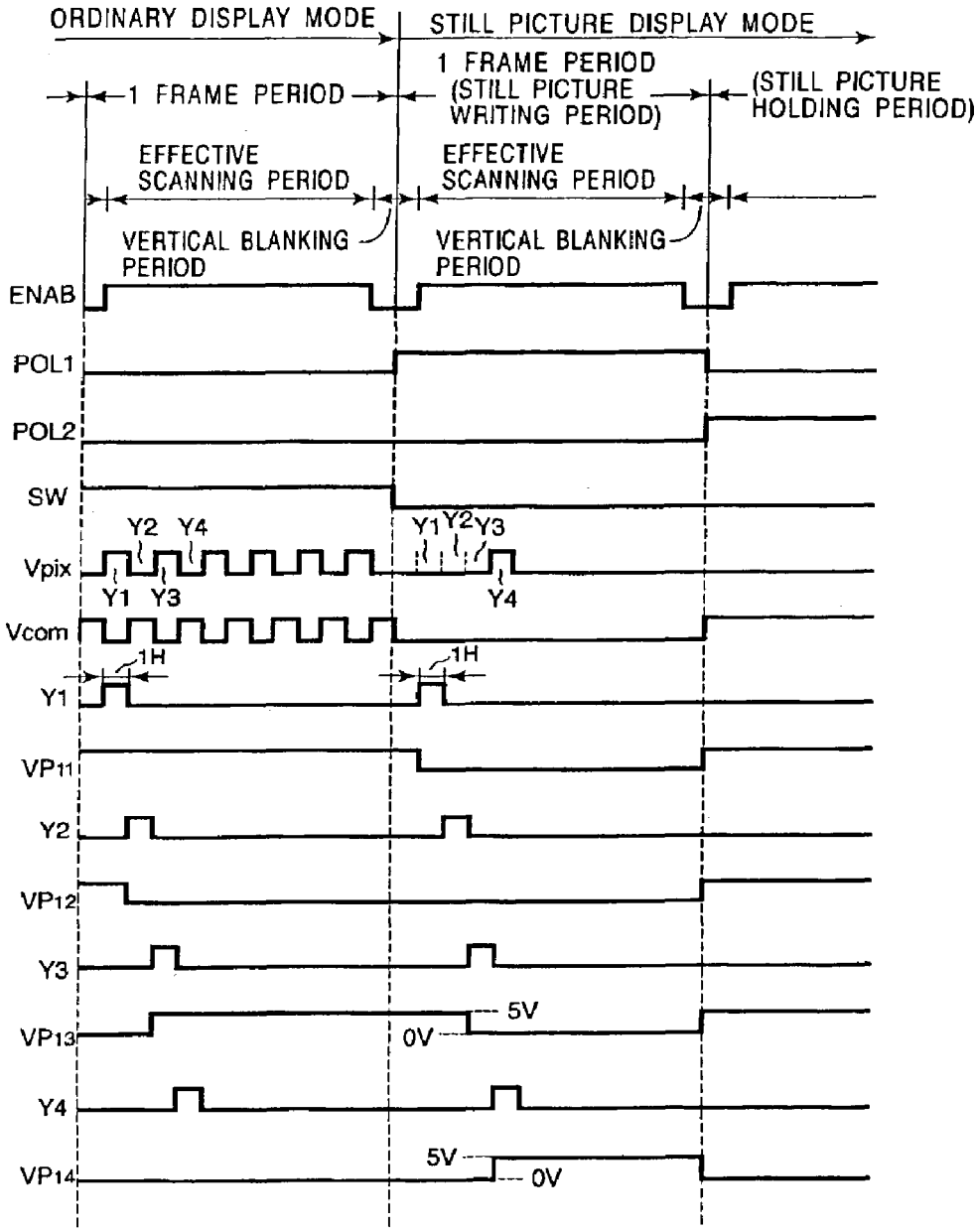
FIG. 3 shows operation time charts of the equivalent circuits described in FIG. 2.

The operation of the liquid crystal display device will be explained below with reference to the drawings. As shown in FIG. 3, the display controller 2 makes the polarity control signals POL1 and PLO2 at a low level and the scanning line driver 3 sequentially supplies scanning signals to the scanning lines Y during a frame period in the ordinary display mode. A high level scanning signal is applied to the scanning line Y only during a horizontal scanning period. The signal line driver 4 supplies the signal lines X with the video signal Vpix for a horizontal scanning period with the polarity changed every horizontal scanning period. The pixel switch 11, at each pixel PE, is enabled in response to the scanning signal applied to scanning line Y, and the video signal Vpix applied to the signal line X is provided to the pixel electrode PE through the enabled pixel switch 11. When the pixel switch 11 is disabled during a horizontal scanning period to make the pixel electrode PE electrically floating, the video signal Vpix will be stored in the electric capacitor (defined by the pixel electrode PE and the common electrode CE) and the auxiliary capacitor CS until the pixel switch 11 is enabled. During that period of time, the optical transparency of the pixel PX is set in response to the potential difference between the common electrode CE and the pixel electrode PE.

When the liquid crystal display device is in the still picture mode, the polarity control signals POL1 and POL2 become at high and low levels, respectively, during a frame period, i.e. during a still picture writing period. The video signal Vpix for a still picture is supplied to the signal line X every horizontal scanning period during such a frame period. During a still picture holding period following the still picture writing period, the polarity control signals POL1 and POL2 reverse the polarity of an output of the memory unit 13 so that the control signals POL1 and POL2 are set to be alternatively at a high level every frame period.

When the control signal POL1 is kept at a high level during the first period corresponding to the still picture writing period in the still picture display mode, the video signal Vpix corresponding to binary coded still pictures is provided to the pixel electrode PE through the pixel switch 11 and also to the digital memory unit 13 through the thin film transistor Q6 of the connection controller 14. When the polarity control signals POL1 and POL2 are, for instance, at low and high levels, respectively, during the still picture holding period, this video signal Vpix is reversed in level by the complementary inverter INV2 and is then provided to the pixel electrode PE through the thin film transistor Q7 of the connection controller 14. Here, with reference to FIG. 3, supplemental explanations are made with respect to the operation during the still picture holding period in the still picture display mode. It is assumed that, at the last frame period in the ordinary display mode, pixel voltages $VP_{11}$, $VP_{12}$, $VP_{13}$, and $VP_{14}$ on the pixels $PX_{11}$, $PX_{12}$, $PX_{13}$, and $PX_{14}$ are set to be 5V, 0V, 5V and 0V, respectively, for the pixels $PX_{11}$, $PX_{12}$, $PX_{13}$, and $PX_{14}$ to be the same in brightness by the line reversal driving scheme, and the video signal Vpix for the still picture is set to be 5V on the fourth scanning line Y4 only during its horizontal scanning period, for instance, and remains 0V for the rest of the frame period. In this case, on one hand, during the still picture writing period, the pixel potential $VP_{11}$ changes from 5V to 0V but the pixel potential $VP_{12}$ remains 0V and unchanged. The pixel potentials $VP_{13}$ and $VP_{14}$, on the other hand, change from 5V to 0V and from 0V to 5V, respectively.

The connection controllers 14 in the liquid crystal display device switch connections between the digital memory units 13 and the pixel electrodes PE when the pixel switches 11 do not read in the video signal during the vertical blanking period. The auxiliary capacitor switches 20 and 21 keep the auxiliary capacitor lines 12 electrically floating in status while the connection controllers 14 connect the memory units 13 to the pixel electrodes PE. Thus, the memory units 13 can substantially exclude the auxiliary capacitor CS from being the capacitive load in response to the polarity reverse of the video signal. This causes the digital memory units 13 to drive pixels properly in accordance with the video signal held in the memory units 13 even if the memory units 13 have less driving capability than the designed value resulting from dispersion of their characteristics due to production processes. That floating arrangement of the present invention can effectively reduce the point defects caused by even such insufficient driving capability of the memory units 13.

Figure 4:
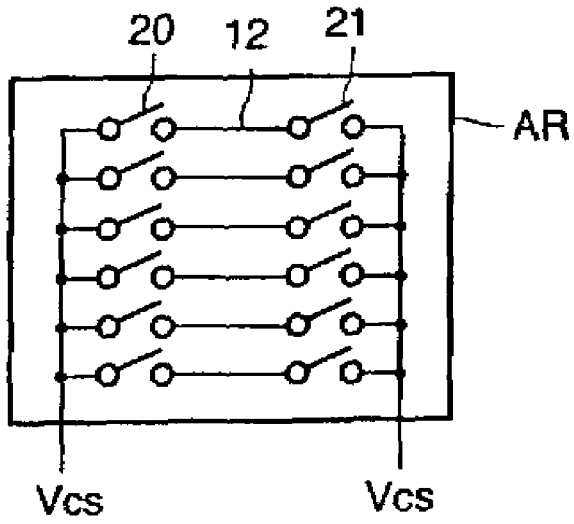
FIG. 4 is a simplified disposition of auxiliary switches shown in FIG. 1.

As shown in FIG. 4 in a simplified fashion, the auxiliary capacitor switches 20 and 21 are connected to the both end terminals of a plurality of the auxiliary capacitor lines 12 on the array substrate AR, respectively. The auxiliary capacitor switches 20 and 21 are connected to the potential setting terminals PVcs where the auxiliary capacitor line potential Vcs are set. The auxiliary capacitor lines 12 connected to two kinds of the auxiliary capacitor switches 20 and 21 are assigned to a plurality of the auxiliary capacitors CS in this embodiment. That is, the number of components is less than that in the case that an auxiliary capacitor switch is assigned to each auxiliary capacitor so that a liquid crystal liquid crystal display device with a lower power consumption can be achieved without reducing an effective display area on the array substrate.

The present invention may be embodied in other specific structures without departing from the spirit or essential characteristics thereof.

The auxiliary capacitor switches 20 and 21, for instance, may be modified to those shown in FIGS. 5 through 9.

Figure 5:
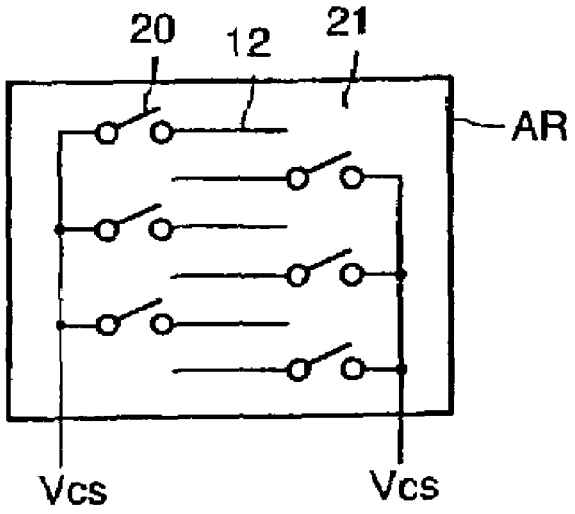
FIG. 5 is a first modification to the auxiliary switches shown in FIG. 4.

In the modification shown in FIG. 5, a plurality of auxiliary capacitor switches 20 and 21 connected to one end terminal and the other of auxiliary capacitor lines 12, respectively, are alternatively provided on the array substrate AR. The auxiliary capacitor switches 20 are connected between end terminals of odd numbers of auxiliary capacitor lines 12 and the potential setting terminal PVcs while other auxiliary capacitor switches 21 are connected between the other end terminals of even numbers of auxiliary capacitor lines 12 and the potential setting terminal PVcs.

Figure 6:
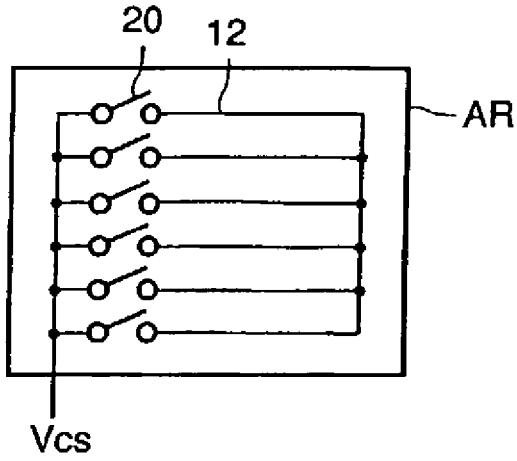
FIG. 6 is a second modification to the auxiliary switches shown in FIG. 4.

In the second modification shown in FIG. 6, a plurality of auxiliary capacitor switches 20 are connected to end terminals of auxiliary capacitor lines 12 on the array substrate AR. All the auxiliary capacitor switches 20 are connected between the end terminals of those auxiliary capacitor lines 12 and the potential setting terminals PVcs and the other end terminals of the auxiliary capacitor lines are connected to each other.

Figure 7:
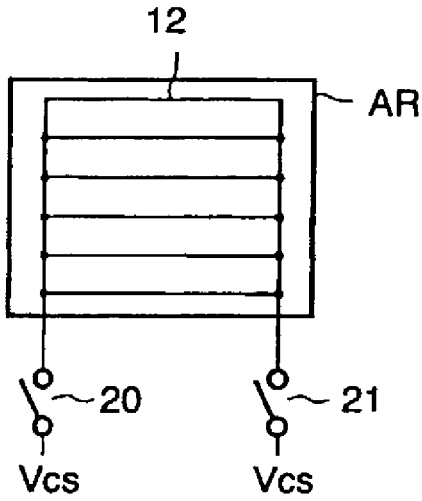
FIG. 7 is a third modification to the auxiliary switches shown in FIG. 4.

In the third modification shown in FIG. 7, two auxiliary capacitor switches 20 and 21 are provided outside of the array substrate AR. The auxiliary capacitor switch 20 is connected between end terminals of auxiliary capacitor lines 12 and a fixed power source terminal Vcs but the auxiliary capacitor switch 21 is connected between other end terminals of auxiliary capacitor lines 12 and the fixed power source terminal Vcs.

Figure 8:
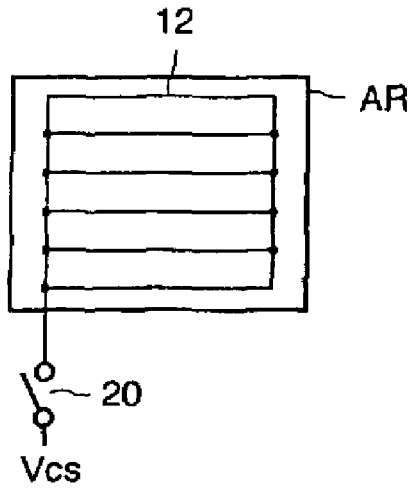
FIG. 8 is a fourth modification to the auxiliary switches shown in FIG. 4.

In the fourth modification shown in FIG. 8, one single auxiliary capacitor switch 20 is provided outside of the array substrate AR. This auxiliary capacitor switch 20 is connected between end terminals of auxiliary capacitor lines 12 and the fixed power source terminal Vcs but other end terminals of the auxiliary capacitor lines 12 are connected to each other.

Figure 9:
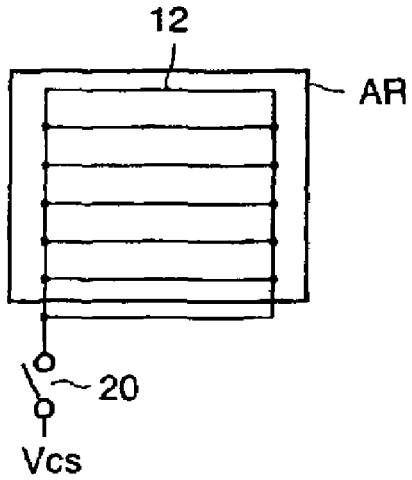
FIG. 9 is a fifth modification to the auxiliary switches shown in FIG. 4.

In the fifth modification shown in FIG. 9, one single auxiliary capacitor switch 20 is provided outside of the array substrate AR as in the modification shown in FIG. 8. This auxiliary capacitor switch 20 is connected between the auxiliary capacitor lines 12 and the fixed power source terminal Vcs. The modifications shown in FIGS. 5 through 9 can reduce the number of components more than in the case that each of the auxiliary capacitor switches 20 is assigned to one auxiliary capacitor CS. Thus, a liquid crystal display device of the present invention can operate in a low power consumption without the reduction of effective display area.

Obviously, numerous additional modifications and variations of the present invention are possible in light of the above teachings. It is therefore to be understood that within the scope of the appended claims, the present invention may be practiced otherwise than as specifically described herein.

The present application is based on Japanese priority document JP 2002-067498, filed Mar. 12, 2002, the entire contents of which are hereby incorporated herein by reference.

What is claimed is:

1. A liquid crystal display device comprising:

pixels including pixel electrodes and a common electrode;

a liquid crystal material held between said pixel electrodes and said common electrode;

pixel switches configured to provide video signals to said pixel electrodes;

memories configured to store the video signals in a digital form supplied from said pixel switches to said pixel electrodes;

connection control circuits configured to connect said memories to said pixel electrodes and to periodically reverse polarities of said video signals output from said memories to said pixel electrodes with respect to a potential of said common electrode;

a potential setting terminal;

auxiliary capacitor lines connected to said potential setting terminal and constituting capacitive coupling with said pixel electrodes; and separation circuits configured to keep said auxiliary capacitor lines in an electrically floating state by electrically disconnecting said auxiliary capacitor lines from said potential setting terminal while said connection control circuits connect said memories to said pixels.

2. The liquid crystal display device according to claim 1, wherein said separation circuits switch and connect said memories to said pixels while said pixel switches do not read in said video signal during a blanking period.

3. The liquid crystal display device according to claim 1, wherein said pixels are disposed in a matrix form on a single display panel, and each of said auxiliary capacitor lines is provided on said display panel to cross corresponding ones of said pixel electrodes.

4. The liquid crystal display device according to claim 3, further comprising auxiliary capacitor switches connected between said auxiliary capacitor lines and said potential setting terminal, wherein said separation circuits are provided at end terminals of said auxiliary capacitor lines.

5. The liquid crystal display device according to claim 3, wherein said separation circuits are provided at a first end terminal of said auxiliary capacitor lines on said display panel and include auxiliary capacitor switches connected between said auxiliary capacitor lines and said potential setting terminal.

6. The liquid crystal display device according to claim 5, wherein said separation circuits are alternatively provided on a first end terminal and a second end terminal of said auxiliary capacitor lines on the display panel and include auxiliary capacitor switches connected between said auxiliary capacitor lines and said potential setting terminal.

7. The liquid crystal display device according to claim 5, wherein said separation circuits are provided outside of said display panel and include at least one auxiliary capacitor switch connected between said auxiliary capacitor lines and said potential setting terminal.

8. A liquid crystal display device comprising:

pixels including pixel electrodes and a common electrode;

a liquid crystal material held between said pixel electrodes and said common electrode;

pixel switching means for providing video signals to said pixel electrodes;

storage means for storing the video signals in a digital form supplied from said pixel switch means to said pixel electrodes;

connection means for connecting said storage means to said pixel electrodes and to periodically reverse polarities of said video signals output from said storage means to said pixel electrodes with respect to potential of said common electrode;

a potential setting terminal;

capacitor line means connected to said potential setting terminal for providing capacitive coupling with said pixel electrodes; and separation means for keeping said capacitor line means in an electrically floating state by electrically disconnecting said capacitor line means from said potential setting terminal while said connection means connects said storage means to said pixels.

9. The liquid crystal display device according to claim 8, wherein said separation means switch and connect said storage means to said pixels while said pixel switch means do not read in said video signal during a blanking period.

10. The liquid crystal display device according to claim 8, wherein said pixels are disposed in a matrix form on a single display panel, and each of said capacitor line means is provided on said display panel to cross corresponding ones of said pixel electrodes.

11. The liquid crystal display device according to claim 10, further comprising capacitor switch means connected between said capacitor line means and said potential setting terminal, wherein said separation means are provided at end terminals of said capacitor line means.

12. The liquid crystal display device according to claim 10, wherein said separation means are provided at a first end terminal of said capacitor line means on said display panel and include capacitor switch means connected between said capacitor line means and said potential setting terminal.

13. The liquid crystal display device according to claim 12, wherein said separation means are alternatively provided on a first end terminal and a second end terminal of said capacitor line means on the display panel and include capacitor switch means connected between said capacitor line means and said potential setting terminal.

14. The liquid crystal display device according to claim 12, wherein said separation means are provided outside of said display panel and include at least one capacitor switch means connected between said capacitor line means and said potential setting terminal.

* * * * *